US005575623A

United States Patent [19]

Christensen et al.

[11] Patent Number: 5,575,623

[45] Date of Patent: Nov. 19, 1996

[54] DRUM ROTOR FOR AN AXIAL-FLOW TURBOMACHINE

[75] Inventors: Flemming Christensen, Rütihof; Uy-Liem Nguyen, Baden-Dättwil, both of Switzerland

[73] Assignee: ABB Management AG, Baden, Switzerland

[21] Appl. No.: 526,104

[22] Filed: Sep. 11, 1995

[30] Foreign Application Priority Data

Oct. 14, 1994 [DE] Germany ..... 44 36 727.9

[51] Int. Cl.[6] ..... F01D 5/30

[52] U.S. Cl. ..... 416/215; 416/219 R

[58] Field of Search ..... 416/215, 216, 416/217, 218, 219 R, 222

[56] References Cited

U.S. PATENT DOCUMENTS 5,236,308 8/1993 Czeratzki ..... 416/215

5,474,423 12/1995 Seeley et al. ..... 416/222

FOREIGN PATENT DOCUMENTS

0478234A1 4/1992 European Pat. Off. .

0520259A1 12/1992 European Pat. Off. .

0520260B1 4/1994 European Pat. Off. .

*Primary Examiner*—James Larson

*Attorney, Agent, or Firm*—Oblon, Spivak, McClelland, Maier & Neustadt, P.C.

[57] ABSTRACT

In a drum rotor (1) for an axial-flow turbomachine, the blades are fastened with their roots (3) in rows in encircling blade grooves (10) having lateral supporting prongs. At least the first blade groove (10), on the inlet side of the working medium, is shaped in an axially asymmetrical manner by a plurality of radii (R1–R4). The preceding radius (R1) in each case is larger than the following radius (R2), and the circular arcs (21–24) formed by the radii (R1–R4) have a common tangent (T) at their contact points.

1 Claim, 1 Drawing Sheet

DRUM ROTOR FOR AN AXIAL-FLOW TURBOMACHINE

BACKGROUND OF THE INVENTION

1. Field of the Invention

The invention relates to a drum rotor for an axial-flow turbomachine, in which the blades are fastened with their roots in rows in encircling blade grooves having lateral supporting prongs.

2. Discussion of Background

EP 0 520 260 B1 discloses drum rotors of this type. As a result of the rotor deflection, the encircling blade grooves change their axial dimension during every rotor revolution. Due to the alternating stresses arising in the process, damage can occur at the rotor recesses. In addition, pronounced asymmetrical displacements can occur in the first blade groove during temperature changes, for example during operational fluctuations. In order to avoid damage, an encircling preliminary groove which is not fitted with blades is normally arranged in front of the first blade groove. However, this preliminary groove weakens the drum rotor and disturbs the flow of the working medium. The preliminary groove is therefore usually fitted with closure segments. The preliminary groove and the closure segments result in additional expenditure of labour during production and assembly as well as additional material consumption.

SUMMARY OF THE INVENTION

Accordingly, one object of the invention, in a drum rotor of the type mentioned at the beginning, is to avoid axial displacements and asymmetrical deformations of the first blade groove by geometric shaping of the blade groove calculated by means of the finite element method.

According to the invention this is achieved when at least the first blade groove, on the inlet side of the working medium, is shaped in an axially asymmetrical manner by a plurality of radii, the preceding radius in each case being larger than the following radius, and the circular arcs formed by the radii having a common tangent at their contact points.

The advantages of the invention can be seen, inter alia, in the fact that the rotor properties remain unchanged. The flow of the working medium is not affected. The blade groove can be produced without substantial additional expenditure, and all conventional parts, such as moving blades, can be used without adaptations.

It is especially convenient when the further blade grooves are shaped asymmetrically in accordance with the first blade groove in order to avoid axial displacements and asymmetrical deformations in them too.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only the elements essential for understanding the invention are shown. Elements of the plant not shown are, for example, all non-rotating parts. The direction of flow of the working medium is designated by an arrow.

DESCRIPTION OF THE PREFERRED EMBODIMENTS

Figure 1:
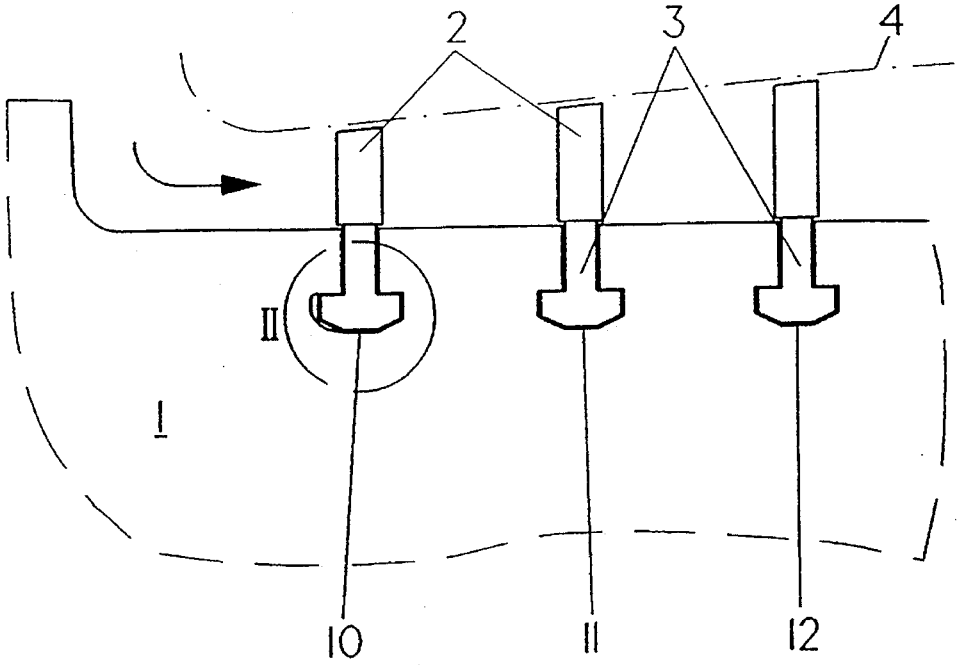
FIG. 1 shows a partial longitudinal section of a bladed drum rotor.

Referring now to the drawings, wherein like reference numerals designate identical or corresponding parts throughout the several views, FIG. 1 shows the first three moving rows of a high-pressure rotor 1. The individual blades, consisting of blade body 2 and blade root 3, are inserted in encircling blade grooves 10, 11 and 12. In this arrangement, the blade groove 10 lies on the steam-inlet side, and the blade groove 12 lies on the steam-outlet side. The flow-limiting contour 4 of the cylinder (not shown) is indicated by dash-dotted lines.

Figure 2:
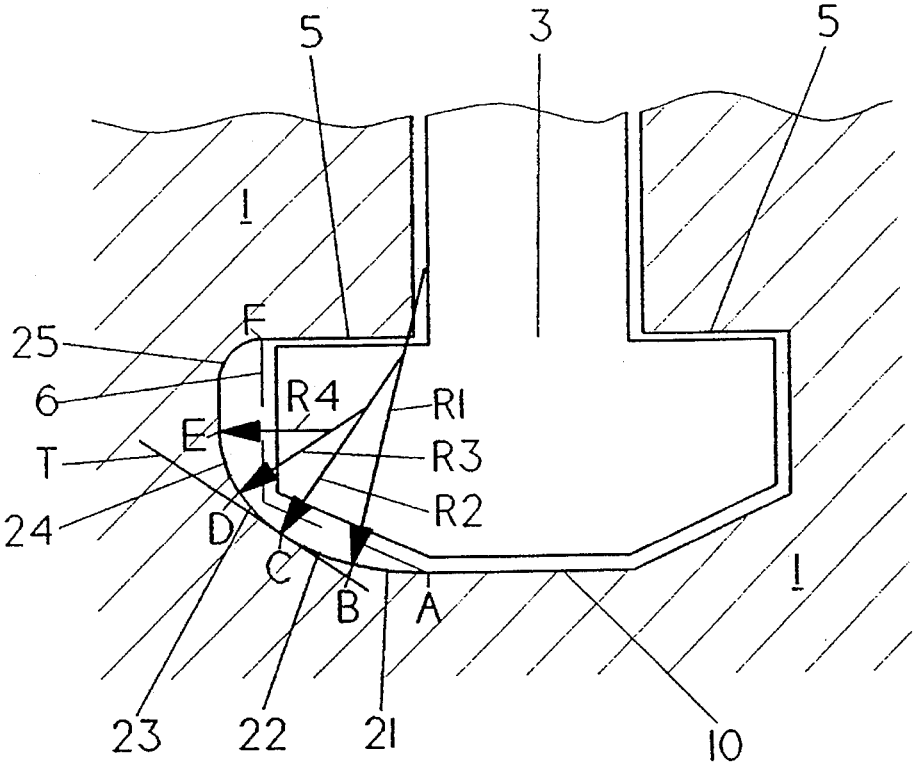
FIG. 2 shows an enlarged section of detail II from FIG. 1.

FIG. 2 shows the hammerhead shape of the blade root 3 in detail. The forces occurring during operation are passed into the rotor 1 via supporting prongs 5 of the blade groove 10.

On the steam-inlet side, the previous groove contour 6 is shown by broken line. On the steam-outlet side, the previous groove contour is retained. The asymmetrical form of the blade groove 10 is described by a plurality of radii R1, R2, R3 and R4 following one another. The radius R1 is greater than R2, R2 is greater than R3, and R3 is greater than R4. Points A, B, C, D and E are defined on the contour of the part of the blade groove 10 which is described by the radii R1 to R4. These points subdivide the contour on the steam-inlet side into circular arcs 21, 22, 23 and 24 described by the radii R1 to R4. Here, circular arc 21 goes from point A to point B, circular arc 22 goes from point B to point C, and so on. The points A–E are each locations of common tangents of the sectional curves touching one another there. Thus a straight line T through the point C is a tangent of the circular arc 22 described by the radius R2, then the straight line T is also a tangent of the circular arc 23 described by the radius R3. It follows from this that the centers of the circular arcs 22 and 23 lie on a perpendicular to the tangent T through the point C. This correspondingly applies to the centers of the further circular arcs. From point E, the groove is returned into the previous groove contour at point F by a curve 25 having essentially any form.

The invention is of course not restricted to the exemplary embodiment shown and described. The number and size of the radii used to describe the asymmetrical groove must be adapted to the respective requirements.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A drum rotor for an axial-flow turbo machine, comprising:

a rotor body including a plurality of blade grooves;

plural blades each having a blade body and a blade root connected to said blade body, each blade being fastened to said rotor body by introducing said blade root into a respective one of the blade grooves;

at least a first of said blade grooves on an inlet side being axially asymmetrically contoured, and having an inlet side wall contour formed by plural circular arcs having progressively increasing radii as said contour extends away from said inlet side, wherein adjoining of one said circular arcs have a common tangent at a connecting point of said adjoining arcs.

* * * * *